US008667641B2

(12) United States Patent
Xue

(10) Patent No.: US 8,667,641 B2
(45) Date of Patent: Mar. 11, 2014

(54) VACUUM CLEANER

(75) Inventor: Jian Xue, JiangSu (CN)

(73) Assignee: Hoover Limited, Merthyr Tydfil (GB)

( * ) Notice: Subject to any disclaimer, the term of this patent is extended or adjusted under 35 U.S.C. 154(b) by 279 days.

(21) Appl. No.: 13/106,915

(22) Filed: May 13, 2011

(65) Prior Publication Data

US 2011/0289724 A1 Dec. 1, 2011

(30) Foreign Application Priority Data

May 28, 2010 (GB) ..... 1008925.8

(51) Int. Cl.
*A47L 5/34* (2006.01)

(52) U.S. Cl.
USPC ..... 15/354; 15/361; 15/333

(58) Field of Classification Search
USPC ..... 15/333, 354, 361
See application file for complete search history.

(56) References Cited

U.S. PATENT DOCUMENTS 3,579,699 A * 5/1971 Balzer ..... 15/361
4,446,594 A * 5/1984 Watanabe et al. ..... 15/323
4,782,552 A * 11/1988 Bartlett et al. ..... 15/333
4,823,430 A * 4/1989 Yonkers et al. ..... 15/361
5,269,042 A * 12/1993 Stephens et al. ..... 15/356
5,906,024 A 5/1999 Jailor et al.
5,974,625 A 11/1999 Garner

FOREIGN PATENT DOCUMENTS

| | | |
|---|---|---|
| EP | 1985218 | 10/2008 |
| GB | 1303352 | 1/1973 |
| GB | 1318099 | 5/1977 |
| WO | WO2006/005722 | 1/2006 |

* cited by examiner

*Primary Examiner* — Dung Van Nguyen
(74) *Attorney, Agent, or Firm* — Gordon & Jacobson, PC

(57) ABSTRACT

A vacuum cleaner comprises an elongate upright body 11 pivotally connected to a floor-engaging foot 10 comprising a motor and fan unit 17 for creating an airflow through the cleaner, the airflow extending between respective ducts 32, 18 in the body 11 and the foot 10 along a neck 20, which is rotatably connected at its lower end to the duct 18 in the foot 10 for rotation about an axis A which extends transversely of the foot 10. The neck 20 acts to support the body 11 on the foot 10 and acts as the point about which relative pivotal movement of the body 10 and foot 11 occurs. An arm 40 is coupled to the neck 20 for actuating a mechanism, which lifts the foot 10 away from the floor surface when the body 10 is in the upright position, so as to prevent the rotating agitator brush 16 in the foot 10 from damaging the floor surface while the cleaner is stood in the upright position when performing above-floor cleaning.

7 Claims, 5 Drawing Sheets

VACUUM CLEANER

CROSS-REFERENCE TO RELATED APPLICATION

This application claims priority from UK Patent App. No. 1008925.8, filed May 28, 2010, which is hereby incorporated by reference herein in its entirety.

BACKGROUND OF THE INVENTION

1. Field of the Invention

This invention relates to a vacuum cleaner and more particularly to a so-called upright vacuum cleaner having a mechanism to lift its rotating agitator brush off the floor when the cleaner is used in above-floor cleaning mode.

2. Related Background Art

Upright cleaners, particularly those equipped for above-floor cleaning tasks, feature a mechanical arrangement, whereby the rotating agitator brush is lifted clear of the floor on which the cleaner is standing when the body of the cleaner is in its upright position, thereby eliminating undesirable contact between the rotating agitator brush and the floor when the cleaner is used in above-floor cleaning mode.

Hitherto, this has been accomplished by mounting the axle of the front wheels of the cleaner on a pair of arms pivoted to the underside of the foot of the cleaner. A cam-follower then co-operates with a cam located on the lower surface of the pivotable body of the cleaner. Pivoting movement of the body relative to the foot causes the pair of arms to pivot about a horizontal axis, thereby raising or lowering the height of the wheels and thus raising or lowering the agitator brush.

One such arrangement is disclosed in GB1303352, which also discloses a manual suction nozzle-height setting arrangement so arranged that, following use of the cleaner for above-floor cleaning, the nozzle height returns to the height setting selected prior to the above-floor cleaning.

A commonly-used alternative to the above-mentioned arrangement is the manually-actuated sliding cam arrangement disclosed in EP0551069.

GB13108099 discloses an alternative arrangement, whereby a formation on the lower extremity of the pivotable body engages the upwardly-projecting end of a rod which runs forward beneath the motor and fan unit to actuate the front wheel axle height setting mechanism. The illustrated embodiment also incorporates a manual nozzle-height setting arrangement employing a Bowden cable actuated by a control knob located at the top of the upright body of the cleaner. The resulting mechanism involves a multi-part linkage which, so as to eliminate exposure to the surface being cleaned and thereby eliminate detrimental effects on the linkage and its pivots, is enclosed in a chamber in the base of the cleaner foot.

EP1985218 discloses a vacuum cleaner in which the upright cleaner body is connected to the foot by a tubular neck formed integrally with a transverse duct which is pivotally mounted to the foot. In such arrangements, the neck and the transverse duct serve to convey airflow between the foot of the cleaner and the upright body.

The arrangement of GB1303352 cannot be used in vacuum cleaners of the kind disclosed in EP1985218 where the motor and fan unit of the cleaner is located in the foot of the cleaner (as distinct from in the base of the upright body), due to the fact that the bulky motor and fan unit is located in the foot between the pivot point and the front wheels. Furthermore, the way in which the bodies of such vacuum cleaners pivot relative to the foot makes it impossible to operate a lifting linkage via a formation on the surface of the body.

Accordingly, an object of the present invention is to provide a vacuum cleaner of the kind having a motor and fan unit located in the foot with an arrangement suitable for lifting the agitator brush away from the floor.

SUMMARY OF THE INVENTION

In accordance with the present invention, there is provided a vacuum cleaner comprising an elongate upright body pivotally connected to a floor-engaging foot comprising a motor and fan unit for creating an airflow through the cleaner, the airflow extending between respective ducts in the body and the foot along a neck which is rotatably connected at its lower end to the duct in the foot for rotation about an axis which extends transversely of the foot, said neck acting to support the body on the foot and acting as the point about which relative pivotal movement of the body and foot occurs, wherein an arm is coupled to the neck for actuating a mechanism which lifts the foot away from the floor surface when the body is in the upright position.

The use of the neck as a member to operate the lifting mechanism enables the agitator brush of a vacuum cleaner of the kind having a motor and fan unit to be lifted away from the floor in a simple manner.

Preferably the neck is rotatably connected at its upper end to the duct in the body for rotation about an axis which extends generally longitudinally of the body.

Preferably the foot comprises at least one front wheel which is moved upwardly and downwardly relative to a chassis of the foot to lower and raise the foot away from the floor surface, the wheel being mounted on an axle which is moved forwardly and rearwardly of the cleaner by said mechanism to lower and raise the foot or vice-versa.

Preferably the mechanism comprises an arm which is coupled at one end to the neck to permit said relative rotation of the neck about said transverse axis.

Preferably an end portion of the arm comprises a formation which is arranged to engage a complementary formation on the neck to displace the arm forwardly and rearwardly of the cleaner as the body is pivoted between an upright position and a near upright position about said transverse axis, said formations being disengaged when the body is pivoted between said near upright position and an inclined position.

Preferably the end portion of the arm comprises a collar which is rotatably mounted to the neck.

Preferably the arm comprises an elongate central portion which is pivotally connected to said end portion of the arm for rotation about an axis which extends parallel to but offset from said transverse axis.

Preferably said axle is biased upwardly against the surface of a displaceable member which can be moved to set the uppermost position of the axle.

BRIEF DESCRIPTION OF THE DRAWINGS

An embodiment of the present invention will now be described by way of an example only and with reference to the accompanying drawings.

DETAILED DESCRIPTION OF THE PREFERRED EMBODIMENT

Figure 1:
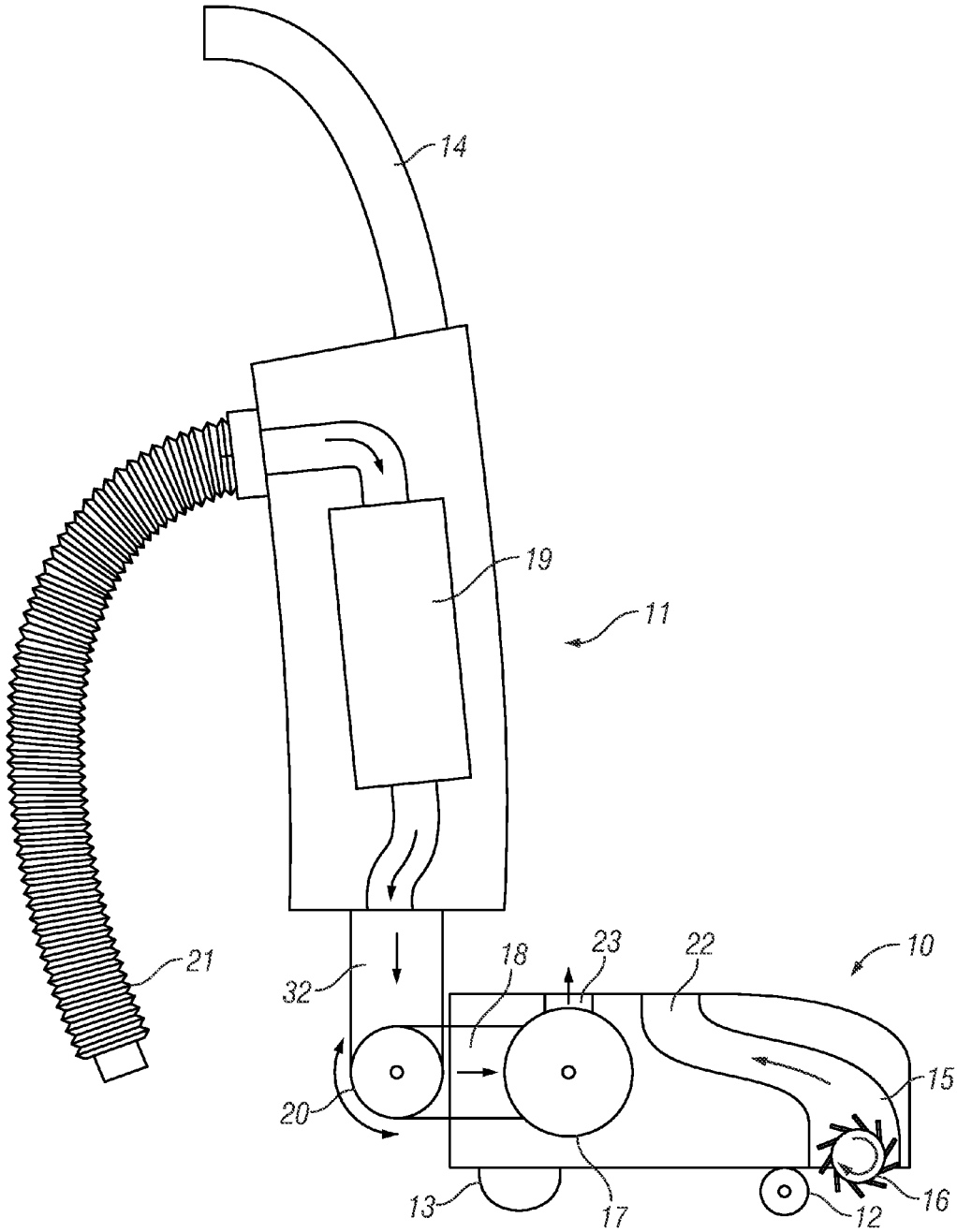
FIG. 1 is a schematic diagram of vacuum cleaner in accordance with this invention.
Figure 2:
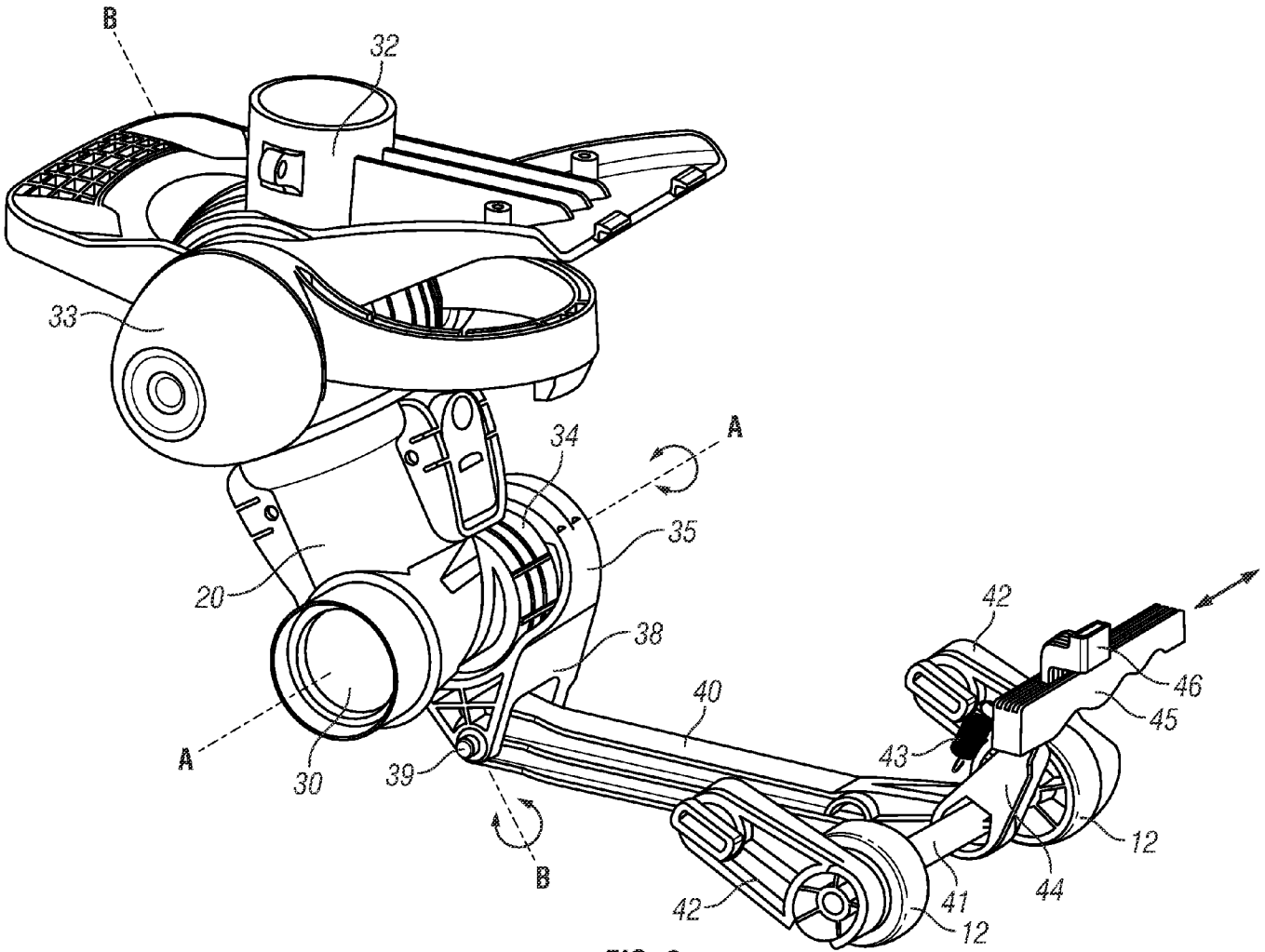
FIG. 2 is a perspective view of a foot height adjusting mechanism of the cleaner of FIG. 1.
Figure 3:
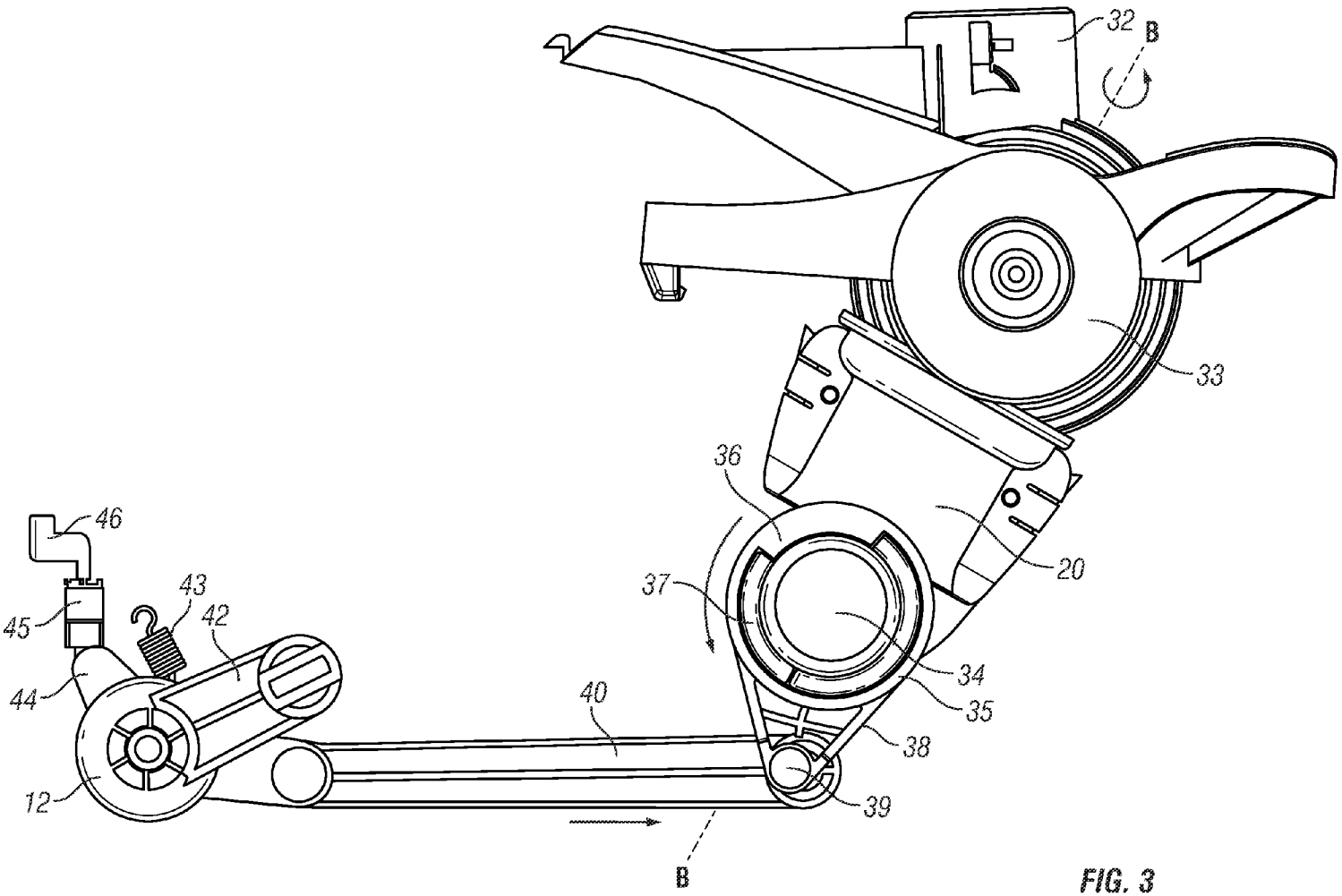
FIG. 3 is a side view of the cleaner mechanism of FIG. 2.

Referring to FIG. 1 of the drawings, there is shown an upright vacuum comprising a foot 10 having floor-engaging front and rear wheels 12,13. An upright body portion 11 is pivotally mounted to the rear of the foot 10 and comprises a handle 14 for guiding the cleaner. The foot 10 comprises an elongate transverse suction inlet 15 disposed adjacent the front wheels 12. A rotary agitator brush 16 extends across the mouth of the inlet 15 for beating and sweeping the floor surface during cleaning.

Figure 4:
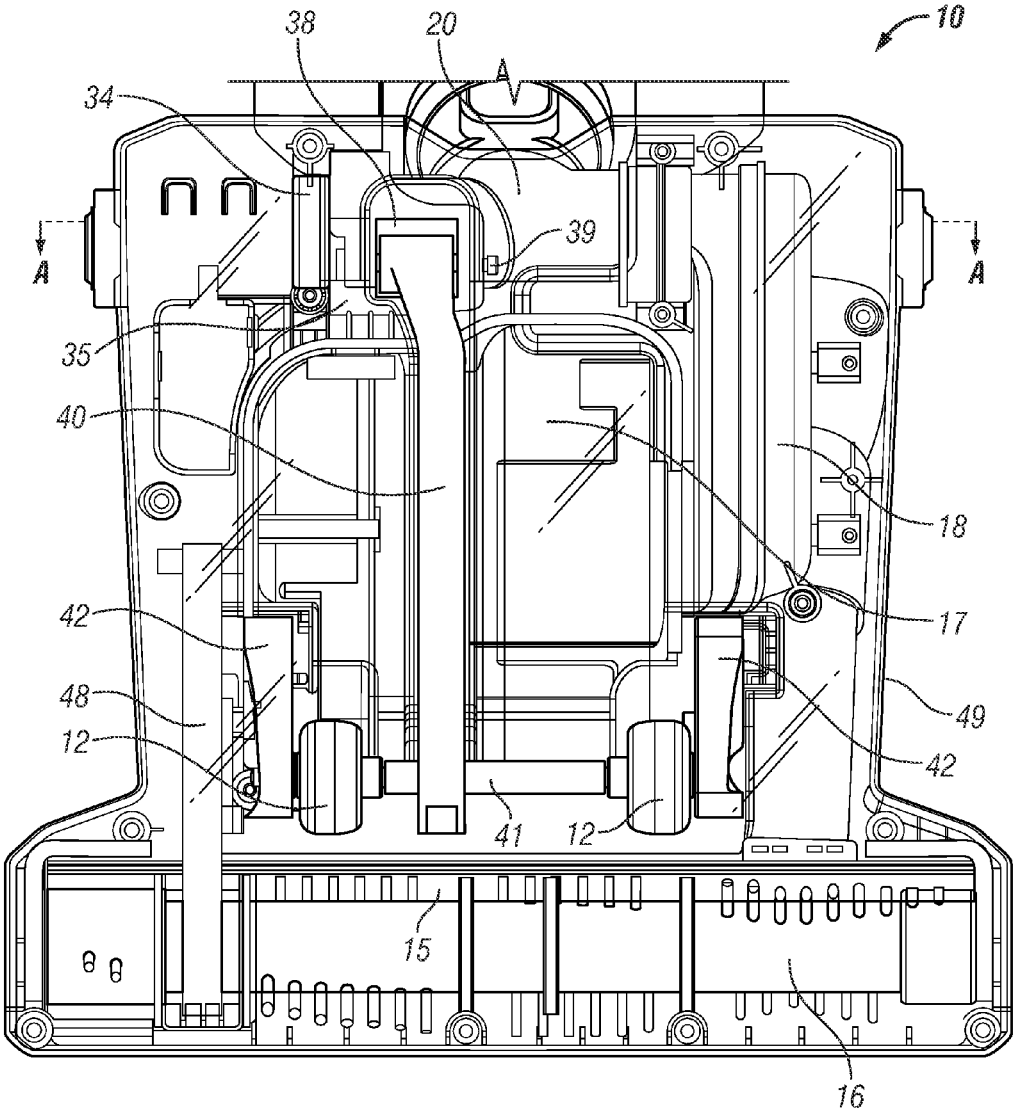
FIG. 4 is a bottom view of a foot of the cleaner of FIG. 1.
Figure 5:
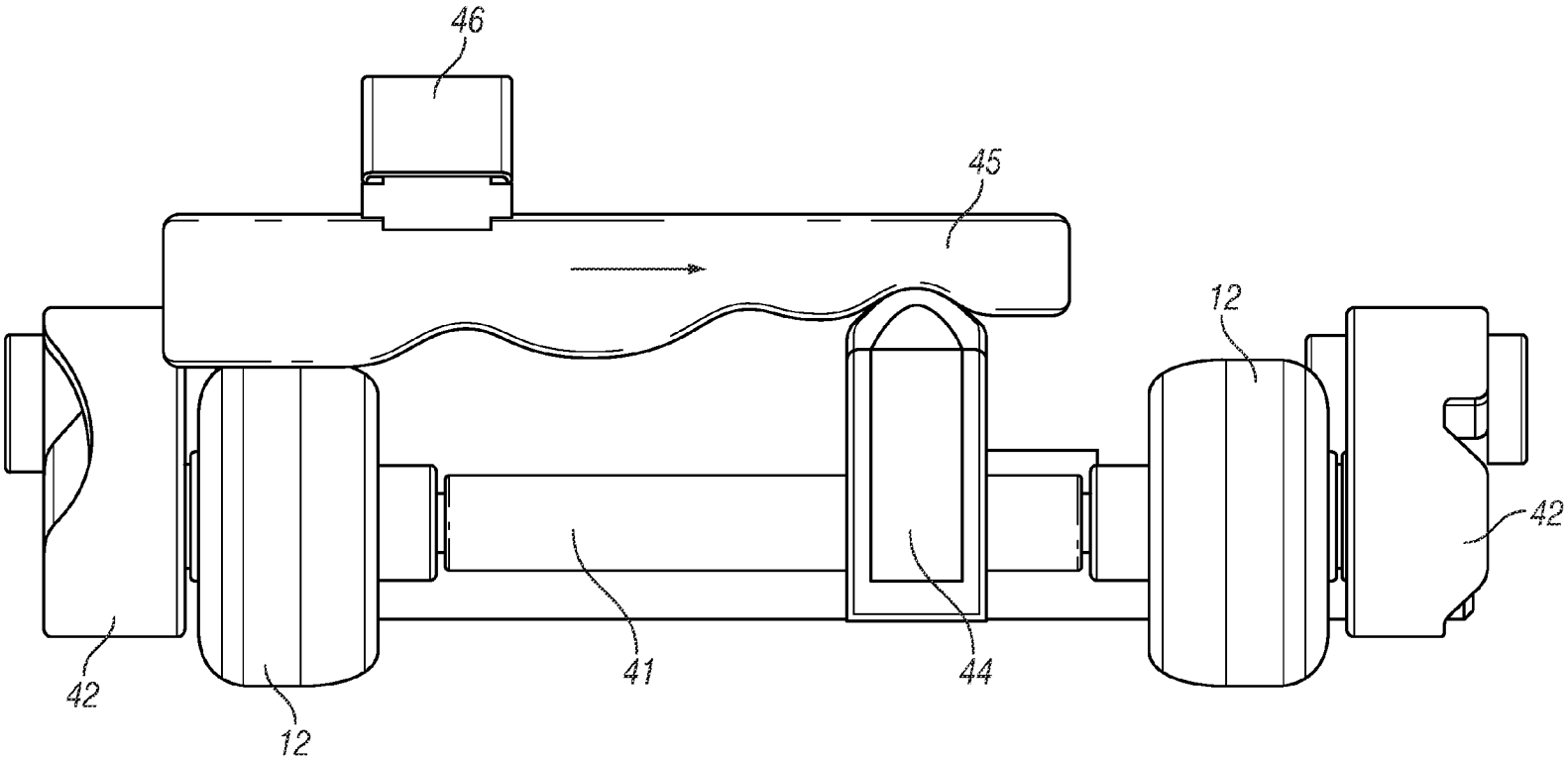
FIG. 5 is a front view of a portion of the mechanism of FIG. 2.

A motor and fan unit 17 disposed in the foot 10 drives the agitator brush 16 via a belt (48 in FIG. 4). The motor and fan unit 17 also creates a reduced air pressure in a duct 18, which leads via a neck 20 to the cleaned air outlet duct of a dust separation device 19 disposed in the body 11. In use the neck 20 acts as the point about which the body 11 can pivot relative to the foot 10. An elongate flexible hose 21 is connected to the dirty air inlet of the dust separation device 19 disposed in the body 11.

In a floor cleaning mode of the cleaner, the distal end of the hose 21 is detachably connected to a port 22 on the foot 10 of the cleaner which leads to the suction inlet 15. Dirt and dust is therefore drawn off the floor into the inlet 15 aided by the action of the rotary agitator 16. The dirt and dust is then carried up the hose 21 to the separation device 19. The cleaned air is then drawn downwardly via the neck coupling 20 into the motor and fan unit 17, whereupon the air is discharged into the atmosphere through an exhaust 23.

In an above-floor cleaning mode of the cleaner, the distal end of the hose 21 is detachably connected to a tool (not shown). The hose 21 is flexible and extendible to allow the tool on the end thereof to be used to clean all kinds of surfaces within reach. Dirt and dust is therefore drawn off the surface and up the hose 21 to the separation device 19. The cleaned air is then drawn downwardly via the neck coupling 20 into the motor and fan unit 17, whereupon the air is discharged into the atmosphere through an exhaust 23. It will be appreciated that the rotary agitator 16 is redundant in above-floor cleaning and indeed the rotating action can damage the floor surface if the cleaner stood in one place during above-floor cleaning. For this reason there is a need to raise the agitator 16 away from the floor surface during above-floor cleaning.

Referring to FIGS. 2 to 5 of the drawings, the neck 20 comprises a central portion which defines an L-shaped duct 30 that carries cleaned air from the separator 19 to the motor and fan unit 17. The neck 20 is rotatably mounted to the rear of the foot 10 for rotation about an axis A, which extends longitudinally along the central axis of a first arm of the L-shaped duct 30 therein and transversely of the cleaner. During rotation, the second arm of the L-shaped duct 30 moves within an upright plane between a generally upright position and rearwardly extending position. The first arm of the L-shaped duct 30 is coupled for rotation about axis A to a duct 18 leading to the motor and fan unit 17. The second arm of the L-shaped duct 30 is coupled for rotation about axis B to a duct 32, which depends from the body 11 of the cleaner and which carries a catch mechanism 33 for releasably retaining the body 11 in the upright position.

The neck 20 also comprises a circular-section boss 34, which axially co-extends with the first end of the duct 30 in a direction which extends in the opposite transverse direction away from the second arm of the duct. A collar 35 is rotatably fitted around the boss 34 for rotation about the axis A. The collar 35 and the boss 34 respectively comprise inwardly and outwardly radially extending lugs 36,37 which are circumferentially positioned to engage each other in the last 20° or so as the body 11 is moved towards the upright position.

The collar 35 comprises a radially-outwardly extending portion 38, which is directed generally downwardly and which is provided with a spindle 39 that extends parallel to the rotational axis A. The spindle 39 extends through an aperture in the rearward end of an elongate arm 40, which extends under the motor and fan unit 17. The forward end of the arm 40 is rotationally engaged to an axle 41 on which the front wheels 12 of the cleaner are mounted. Opposite ends of the axle 41 are pivotally connected via rearwardly extending arms 42 to the chassis of the foot 10 of the cleaner. A spring 43 is connected between the forward end of the arm 40 and the chassis of the foot 10 of the cleaner to apply an upward bias to the axle 41.

An arm 44 extends radially upwardly from the centre of the axle 41, the upper end of the arm 44 being biased against the bottom face of an elongate member 45 which slidably mounted for transverse movement inside the foot 10 of the cleaner. An actuator 46 extends upwardly from the member 45 through a transverse slot (not shown) in the housing 49 of the foot 10. The bottom face of the member 45 is progressively stepped in height along its length.

In use, when performing floor cleaning, the user releases the catch 33 and pivots the body 11 rearwardly so that the foot 10 can be guided over the floor using the handle 14. In this rearward position of the body 11, the lugs 36,37 are disengaged allowing the collar 38 to freely rotate to move the arm 40 forwardly under the applied bias of the spring 43: this then allows the axle 41 to move upwardly until the arm 44 abuts the bottom face of the member 45. It will be appreciated that the height of the front wheels 12 during floor cleaning can thus be set by sliding the member 45 transversely of itself.

In use, when performing above-floor floor cleaning, the user pivots the body 11 forwardly until the catch 33 engages the foot 10. In this forward position of the body 11, the lugs 36,37 engaged each other during the last 20 degrees of movement, thereby forcing the collar 38 to rotate to pull the arm 40 rearwardly against the applied bias of the spring 43: the arm pulls the axle 41 downwardly and lowers front wheels 12. The lowering of the front wheels 12 acts to raise the foot 10 so that the agitator brush 16 is lifted away from the floor during above floor cleaning.

A vacuum cleaner in accordance with the present invention is simple in construction yet avoids damage to the floor surface when the cleaner is stood in one place, for example during above-floor cleaning.

While the preferred embodiment of the invention has been shown and described, it will be understood by those skilled in the art that changes of modifications may be made thereto without departing from the true spirit and scope of the invention.

What is claimed is:

1. A vacuum cleaner comprising an elongate upright body pivotally connected to a floor-engaging foot having a motor and fan unit for creating an airflow through the cleaner, the airflow extending between respective ducts in the body and the foot along a neck which is rotatably connected at its lower end to the duct in the foot for rotation about an axis which extends transversely of the foot, said neck acting to support the body on the foot and acting as the point about which relative pivotal movement of the body and foot occurs, wherein an arm is coupled to the neck for actuating a mechanism which lifts the foot away from the floor surface when the body is in the upright position, the arm comprising a rear end portion coupled to the neck to permit relative rotation of the neck and the arm about said transverse axis.

2. A vacuum cleaner as claimed in claim 1, in which the neck is rotatably connected at its upper end to the duct in the body for rotation about an axis which extends generally longitudinally of the body.

3. A vacuum cleaner as claimed in claim 1, in which the rear end portion of the arm comprises a formation which is arranged to engage a complementary formation on the neck to displace the arm forwardly and rearwardly of the cleaner as the body is pivoted between an upright position and a near upright position about said transverse axis, said formations being disengaged when the body is pivoted between said near upright position and an inclined position.

4. A vacuum cleaner as claimed in claim 3, in which the rear end portion of the arm comprises a collar which embraces the neck.

5. A vacuum cleaner as claimed in claim 3, in which the arm comprises an elongate central portion which is pivotally connected to said rear end portion of the arm for rotation about an axis which extends parallel to but offset from said transverse axis.

6. A vacuum cleaner as claimed in claim 1, in which said mechanism is arranged to move a front wheel of the foot upwardly and downwardly relative to a chassis of the foot to lower and raise the foot away from the floor surface, the wheel being mounted on an axle which is moved forwardly and rearwardly of the cleaner by said mechanism to lower and raise the foot or vice-versa.

7. A vacuum cleaner as claimed in claim 6, in which said axle is biased upwardly against the surface of a displaceable member which can be moved to set the uppermost position of the axle.

* * * * *